US006312031B1

(12) United States Patent
Norton, Jr.

(10) Patent No.: US 6,312,031 B1
(45) Date of Patent: Nov. 6, 2001

(54) DEVICE FOR RETRIEVING AN OBJECT IN A FLUID AND METHOD THEREFOR

(76) Inventor: Charles L. Norton, Jr., 2869 Meadow Dr., Marietta, GA (US) 30062

( * ) Notice: Subject to any disclaimer, the term of this patent is extended or adjusted under 35 U.S.C. 154(b) by 0 days.

(21) Appl. No.: 09/591,651

(22) Filed: Jun. 10, 2000

(51) Int. Cl.[7] ..... B25J 15/06; B63C 7/00
(52) U.S. Cl. ..... 294/64.1; 294/66.1
(58) Field of Search ..... 294/1.2, 64.1, 294/64.2, 64.3, 66.1, 66.2, 68.22, 68.25, 50.7

(56) References Cited

U.S. PATENT DOCUMENTS

| | | | | |
|---|---|---|---|---|
| 327,394 | | 9/1885 | Hemsley . | |
| 498,966 | * | 6/1893 | Barker | 294/68.25 |
| 565,763 | * | 8/1896 | Lowderbaugh | 294/68.22 |
| 1,055,385 | * | 3/1913 | Cahill | 294/68.25 |
| 1,431,396 | * | 10/1922 | Gruber | 294/68.25 |
| 1,989,443 | | 1/1935 | Arnold . | |
| 2,702,125 | * | 2/1955 | Willinger et al. | 294/68.22 |
| 3,089,721 | * | 5/1963 | Puckett | 294/50.7 |
| 4,244,614 | * | 1/1981 | Madsen | 294/50.7 |
| 4,265,476 | | 5/1981 | Elgart . | |
| 4,553,819 | | 11/1985 | Correll . | |
| 4,602,846 | | 7/1986 | Karnes . | |
| 4,858,975 | * | 8/1989 | Ogawa | 294/64.1 |
| 4,884,871 | | 12/1989 | Creech, Jr. . | |
| 4,995,662 | * | 2/1991 | Hawkswell | 294/64.1 |
| 5,144,481 | | 9/1992 | Pettito, Sr. . | |
| 5,348,359 | | 9/1994 | Boozer . | |
| 5,374,092 | | 12/1994 | Salinas . | |
| 5,458,386 | | 10/1995 | Buthman . | |
| 5,928,537 | | 7/1999 | Fortune . | |

* cited by examiner

*Primary Examiner*—Dean J. Kramer
(74) *Attorney, Agent, or Firm*—Joel D. Myers; Myers & Associates, Intellectual Property Law, P.C.

(57) ABSTRACT

A device for retrieving an object that is submerged in a fluid. A first member, preferably formed in the shape of a cylinder, has an open top end and a bottom wall. The bottom wall has a hole therethrough that provides an inlet that allows the object to be retrieved to come within the device. A second member, also preferably formed in the shape of a cylinder, has an open top and a passageway therethrough that is in fluid communication with the hole in the bottom wall of the first member. The passageway has a first portion positioned above the hole and a second portion that extends to the top of second member. First portion is preferably perpendicular to second portion so that the object to be retrieved is trapped within first portion. In use the open top end of second member is covered. Next, the device is submerged in the fluid so that the hole is aligned over the object to be retrieved. In order to trap object in the first portion of passageway, simply uncover the top end of second member. As a result of uncovering the top end of second member, the negative pressure within passageway sucks the object into first portion of passageway.

20 Claims, 1 Drawing Sheet

DEVICE FOR RETRIEVING AN OBJECT IN A FLUID AND METHOD THEREFOR

TECHNICAL FIELD

The present invention relates generally to devices that retrieve objects that are submerged in a fluid and, more specifically, to a device that uses negative pressure to retrieve an object from a fluid.

BACKGROUND ART

There are many situations in which an object must be retrieved from a fluid. The object may have fallen into a fluid by accident or may have been purposely submerged in a fluid for cleaning. For example, ultrasonic jewelry cleaners enjoy widespread use by professional jewelers. However, problems occur when an individual gemstone becomes dislodged from its setting while in the cleaner. The gemstone is extremely difficult to locate and retrieve due to the murkiness and the heat of the cleaning fluid used in the cleaner. In order to retrieve the gemstone, one must typically go through the time consuming task of straining the cleaning fluid to retrieve the loose gemstone. For other loose objects, the availability of straining the fluid may be not only impractical, but actually impossible, depending upon the environment of the fluid.

There have been a myriad of attempts in the prior art to develop a device that can easily and simply retrieve an object that is submerged in a fluid. Unfortunately, these devices are overly complex and often require many attempts to successfully retrieve the object from the fluid. For example, U.S. Pat. No. 5,374,092 to Salinas describes a device for retrieving a gemstone that is submerged in a cleaning solution. The user is required to locate the gemstone using the sighting shaft and then must retrieve the gemstone using attached tweezers. Unfortunately, it is difficult for a user to effectively grasp the gemstone between the arms of the tweezers.

Therefore, there is a need for a simple and effective device for retrieving an object from a fluid, which does not require the user to make numerous attempts.

BRIEF SUMMARY OF THE INVENTION

Briefly described, in a preferred embodiment, the present invention overcomes the above-mentioned disadvantages by providing a new and improved device for retrieving an object that is submerged in a fluid that is simple to manufacture and use. A first member, preferably formed in the shape of a cylinder, has an open top end and a bottom wall. The bottom wall has an aperture therethrough that provides an inlet that allows the object to enter within the device. A second member, also preferably formed in the shape of a cylinder, has an open top and a passageway therethrough that is in fluid communication with the hole in the bottom wall of the first member. The passageway has a first portion positioned above the hole and a second portion that extends to the top of second member. The first portion is preferably perpendicular to the second portion so that the object to be retrieved is trapped within the first portion. In use the open top end of second member is covered, preferably by the user's finger. Next, the device is submerged in the fluid so that the hole is aligned over the object to be retrieved. In order to trap the object in the first portion of the passageway, the top end of second member is simply uncovered. As a result of uncovering the top end of the second member, the negative pressure within the passageway, formed when the device was inserted into the liquid, sucks the object into first portion of passageway.

A major advantage of the present invention is its simplicity of use. In operating the retriever, the user merely needs to move a single finger to cover and uncover the opening to the second member. This operation creates a negative pressure within the passageway so as to draw the object into the retriever. As a result, the user will not require many attempts to retrieve an object.

Since the present invention does not have any moving parts, the simplicity of manufacture is another advantage. As a result of this simplicity, the present invention can be manufactured at a much cheaper cost than prior art retrievers.

These and other objects, features and advantages of the invention will become more apparent to one skilled in the art from the following description and claims when read in light of the accompanying drawings.

DETAILED DESCRIPTION OF THE PREFERRED EMBODIMENT

In describing the preferred embodiment of the present invention illustrated in the figures, specific terminology is employed for the sake of clarity. The invention, however, is not intended to be limited to the specific terminology so selected, and it is to be understood that each specific element includes all technical equivalents that operate in a similar manner to accomplish similar functions.

With regard to all such embodiments as may be herein described and contemplated, it will be appreciated that optional features, including, but not limited to, aesthetically pleasing coloration and surface design, and labeling and brand marking, may be provided in association with the present invention, all without departing from the scope of the invention.

Figure 1:
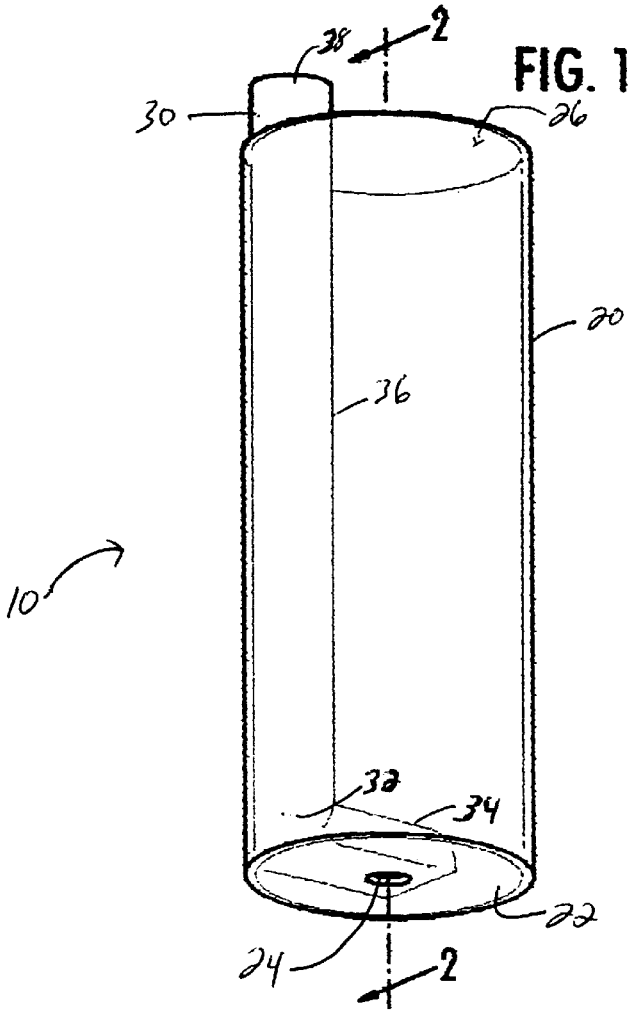
FIG. 1 is a perspective view of the present invention according to a preferred embodiment.
Figure 2:
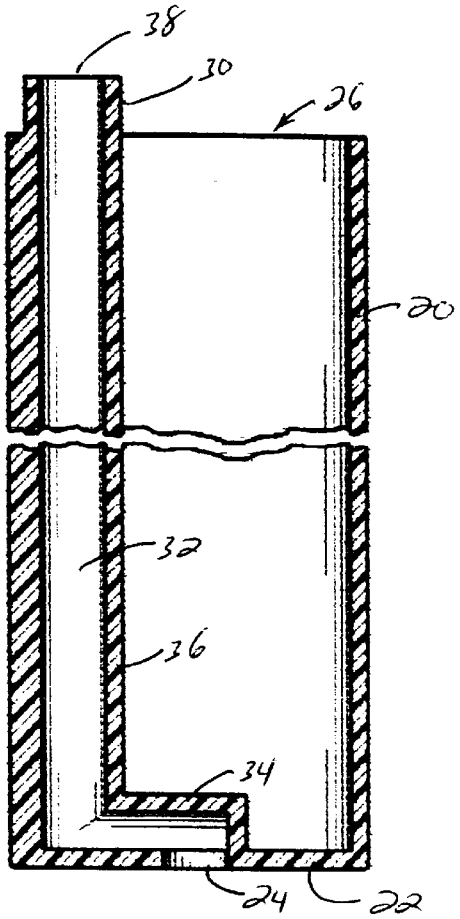
FIG. 2 is a side cross-sectional view of the present invention according to a preferred embodiment.

Referring now to FIGS. 1 and 2, there is shown a retriever according to a preferred embodiment of the present invention. The retriever, generally referred to by reference number 10, comprises a first member 20 having a bottom wall 22 with a hole 24 and a second member 30 having a passageway 32 therethrough that is in fluid communication with hole 24 in bottom wall 22. Retriever 10 is capable of drawing an object submerged in a fluid within passageway 32.

First member 20 is preferably formed in the shape of a cylinder. First member 20 has an open end 26 and an opposing bottom wall 22. Bottom wall 22 has a hole 24 therethrough with sufficient diameter to allow the object to be retrieved to pass therethrough. Hole 24 provides an inlet that allows the object to be retrieved to be drawn within retriever 10. Although hole 24 is preferably positioned concentrically in bottom wall 22, the exact position of hole 24 in bottom wall 22 is not essential to the operation of retriever 10. In order to retrieve an object, hole 24 is aligned over the object to be retrieved. Accordingly, bottom wall 22 is preferably formed from a translucent or transparent material to help in locating and aligning the object with hole. Other portions of first member 20 are also preferably transparent or translucent to permit entry of additional light to facilitate sighting of the object through bottom wall 22. Bottom wall 22 is preferably formed of a thin, preferably approximately 1 mm, material to further facilitate sighting of the object.

A second member 30 is also preferably formed in the shape of a cylinder. Second member 30 has an open top 38 and a passageway 32 therethrough that is in fluid communication with hole 24 in bottom wall 22 of first member 20. Passageway 32 has a first portion 34 positioned above the hole 24 and a second portion 36 that extends to the top 38 of second member 30. First portion 34 is preferably perpendicular to second portion 36 so that the object to be retrieved is trapped within first portion 34. As with bottom wall 22 of first member 20, preferably second member 30 is formed from a translucent or transparent material.

In use, the top end 38 of second member 30 is covered, with the user's finger or other object. Next, retriever 10 is submerged in the fluid such that bottom wall 22 is in close proximity to the bottom of the fluid container and hole 24 is aligned over the object to be retrieved. Objects are more easily located through the thin layer of solution between the container bottom and bottom wall 22. The surface area of bottom member 22 is large enough to cover the object to be located. The pressure of the fluid on the air trapped within passageway 32 causes a negative pressure therein as retriever 10 is lowered into the fluid. In order to trap the object in first portion 34 of passageway 32, the top end 38 of second member 30 is uncovered. As a result of uncovering the top end 38 of second member 30, the negative pressure within passageway 32 draws the object along with a small amount of fluid into first portion 34 of passageway 32. The retriever 10 having the object therein is then withdrawn from the fluid and filled such that the fluid and the object are evacuated from passageway 32.

Normally, overhead light is sufficient to allow sighting of the object through bottom wall 22. If not, however, a flashlight or other similar light source can be shined down first member 20

Having thus described exemplary embodiments of the present invention, it should be noted by those skilled in the art that the within disclosures are exemplary only, and that various other alternatives, adaptations, and modifications may be made within the scope of the present invention. Accordingly, the present invention is not limited to the specific embodiments illustrated herein, but is limited only by the following claims.

What is claimed is:

1. A device for retrieving an object that is submerged in a fluid, said device comprising:

a first member having a bottom wall, said bottom wall having a hole therethrough;

a second member carried within said first member and having a passageway therethrough, said passageway in fluid communication with said hole, said second member having a first portion and a second portion, said first portion being generally parallel with said bottom wall and proximal thereto, said second portion being generally perpendicular to said first portion; and suction means for creating a negative pressure within aid passageway.

2. The device as recited in claim 1, wherein said passageway has a first portion and a second portion in fluid communication with said first portion and with said hole, said second portion being approximately perpendicular to said first portion.

3. The device as recited in claim 1, wherein said first member and said second member are formed in the shape of a cylinder, said first member having a greater diameter than the diameter of said second member.

4. The device as recited in claim 1, wherein said suction means is capable of creating a negative pressure within passageway when said second member is submerged in a fluid.

5. The device as recited in claim 1, wherein said hole is concentrically positioned in said bottom wall.

6. The device as recited in claim 1, wherein said bottom wall is formed from a translucent material.

7. The device as recited in claim 1, wherein both said first member and said second member are formed from a translucent material.

8. The device as recited in claim 1, wherein both said first member and said second member are formed from a transparent material.

9. A device for retrieving an object that is submerged in a fluid, said device comprising:

a first member having a bottom wall, said bottom wall having a hole therethrough;

a second member carried within said first member and having a passageway therethrough, said passageway in fluid communication with said hole, said passageway having a first portion and a second portion in fluid communication with said first portion and with said hole, said first portion being generally parallel with said bottom wall, said second portion being approximately perpendicular to said first portion; and suction means for creating a negative pressure within said passageway.

10. The device as recited in claim 9, wherein said first member and said second member are formed in the shape of a cylinder, said first member having a greater diameter than the diameter of said second member.

11. The device as recited in claim 9, wherein said suction means is capable of creating a negative pressure within passageway when said second member is submerged in a fluid.

12. The device as recited in claim 9, wherein said hole is concentrically positioned in said bottom wall.

13. The device as recited in claim 9, wherein said bottom wall is formed from a translucent material.

14. The device as recited in claim 9, wherein both said first member and said second member are formed from a translucent material.

15. The device as recited in claim 9, wherein both said first member and said second member are formed from a transparent material.

16. A method for retrieving an object from a fluid using a member having a passageway therethrough, said passageway having a first portion and a second portion in fluid communication with said first portion, said first portion being generally parallel with a bottom wall of said member, said second portion being approximately perpendicular to said first portion, and wherein the passageway has a first end and a second end, said method comprising the steps of:

covering said first end of said passageway;

submerging said second end of said member in the fluid; and trapping the object in said first portion of said passageway.

17. The method as recited in claim 16, wherein said trapping step is performed by creating a negative pressure within the passageway.

18. The method as recited in claim 16, wherein said trapping step is performed by uncovering the first end of the passageway.

19. The method as recited in claim 16, further comprising the step of aligning the object with the second end of the passageway.

20. The method as recited in claim 16, wherein a transparent member is submerged in said submerging step.

* * * * *